US012595107B1

(12) United States Patent
Thalmann

(10) Patent No.: US 12,595,107 B1
(45) Date of Patent: Apr. 7, 2026

(54) SYSTEMS AND METHODS FOR SECURING CONTAINER CONTENTS

(71) Applicant: Inner Limit, LLC, Ottertail, MN (US)

(72) Inventor: Matthew Thalmann, Ottertail, MN (US)

(73) Assignee: INNER LIMIT, LLC, Ottertail, MN (US)

( * ) Notice: Subject to any disclaimer, the term of this patent is extended or adjusted under 35 U.S.C. 154(b) by 0 days.

(21) Appl. No.: 19/077,815

(22) Filed: Mar. 12, 2025

(51) Int. Cl.
*B65D 81/05* (2006.01)
*B65D 81/38* (2006.01)

(52) U.S. Cl.
CPC ..... *B65D 81/052* (2013.01); *B65D 81/3813* (2013.01)

(58) Field of Classification Search
CPC .. B65D 81/052; B65D 81/3813; B65D 81/03; A45C 13/021
USPC ..... 220/592.01; 206/522, 814; 383/3
See application file for complete search history.

(56) References Cited

U.S. PATENT DOCUMENTS 4,905,835 A * 3/1990 Pivert ..... B65D 81/052 383/3
5,397,000 A * 3/1995 Holte ..... B65D 81/052 206/545
10,233,005 B1 * 3/2019 De Bonet ..... B65D 81/052
2010/0200349 A1 * 8/2010 Su ..... A45C 13/021 190/103
2017/0320650 A1 * 11/2017 Aguilar ..... B65D 81/03

* cited by examiner

*Primary Examiner* — Don M Anderson
*Assistant Examiner* — Elizabeth J Volz
(74) *Attorney, Agent, or Firm* — Haynes & Boone, LLP

(57) ABSTRACT

A system for securing contents comprises a cooler having a body and a lid. The body and the lid define a reservoir to hold the contents. An expandable device is positionable in the cooler and is configured to secure the contents in the reservoir by occupying at least a portion of a space in the reservoir unoccupied by the contents. The expandable device is inflatable and reusable to secure the contents in the reservoir during a first use and to secure second contents in the reservoir during a second use. The expandable device is deflatable between the first use and the second use.

20 Claims, 5 Drawing Sheets

SYSTEMS AND METHODS FOR SECURING CONTAINER CONTENTS

TECHNICAL FIELD

This disclosure relates generally to the transportation of goods, and more specifically to systems and methods for securing container contents.

BACKGROUND

The transportation of goods frequently involves the use of containers such as luggage, coolers, crates, storage bins, shipping boxes, and shipping containers, among other containers. Ensuring that the contents of these containers remain secure during transit is a persistent challenge, especially when the containers are subjected to movement, vibrations, impacts, or changes in orientation. Failure to adequately secure container contents can result in damage to the items, loss of integrity, and inefficiencies in transportation logistics.

Traditional methods for securing contents rely on rudimentary solutions, require significant preparation time, are not reusable, and fail to adapt to varying sizes of the containers and contents therein. In the case of temperature-sensitive goods, such as food, beverages, medical supplies, and living organisms, the need for secure containment is compounded by the necessity to maintain consistent cooling or heating conditions. Unsecured contents can shift, compromising thermal insulation and potentially causing spoilage or degradation of the contents. Current solutions often neglect this critical intersection of physical security and temperature stability.

It is therefore desirable to provide improved systems and methods that address the above described problems and/or generally offer improvements or alternatives to existing systems and methods. Such advancements would enhance the safety, efficiency, and usability of containers in a variety of applications, including personal travel, commercial logistics, and medical transportation.

SUMMARY

Consistent with some examples, a system for securing contents may comprise a cooler comprising a body and a lid, the body and the lid defining a reservoir to hold the contents, and an expandable device positionable in the cooler and configured to secure the contents in the reservoir by occupying at least a portion of a space in the reservoir unoccupied by the contents, wherein the expandable device is inflatable and reusable to secure the contents in the reservoir during a first use and to secure second contents in the reservoir during a second use, the expandable device being deflatable between the first use and the second use.

In some examples, the expandable device may be inflatable when the lid is closed. The expandable device, when inflated, may configured to apply an upward force against the lid and a downward force against the contents to secure the contents in the reservoir. The expandable device may comprise a flexible membrane conformable to a first configuration based on a first shape of the space in the reservoir unoccupied by the contents and conformable to a second configuration based on a second shape of the space in the reservoir unoccupied by second contents. The first shape of the space may be different than the second shape of the space such that the first configuration is different than the second configuration.

In some examples occupying at least the portion of the space in the reservoir unoccupied by the contents may include occupying at least a third of the space in the reservoir unoccupied by the contents. The expandable device may be coupled to the reservoir when securing the contents. The expandable device may include at least one fastening mechanism configured to removably couple the expandable device to a downwardly facing surface of the lid.

In some examples, the expandable device may be housed within but unattached from the cooler when securing the contents. The upper portion of the reservoir may be formed by a recess in the lid, and wherein the expandable device, when deflated, is shaped to be stored in the recess in the lid. The expandable device may an inflation valve and wherein the cooler comprises an access port, the inflation valve being accessible through the access port. The access port may extend through a side wall of the lid.

In some examples, the system may further comprise a pump usable to inflate the expandable device. The pump may be integrated into the cooler and may be a manual pump. The pump may be integrated into the cooler and may be an automatic pump. The automatic pump may be configured to stop inflating the expandable device upon receipt of a signal from at least one pressure sensor indicating that a pressure inside the inflated expandable device is within a threshold pressure range, and wherein the automatic pump is configured to begin inflating the expandable device upon receipt of a signal from the at least one pressure sensor indicating that the pressure inside the inflated expandable device has dropped below the threshold pressure range.

In some examples, the expandable device may include a flexible membrane having a main chamber fluidically connected to a plurality of extension chambers, each of the plurality of extension chambers configured to occupy a respective space above respective contents in the cooler, wherein an inflated length of each extension chamber corresponds to a height of the respective contents in the respective space. The expandable device may comprise at least one handle usable to insert and remove the expandable device from the cooler between uses.

Consistent with some examples, a method for securing contents may comprise placing an expandable device on top of contents in a reservoir of a cooler having a lid, closing the lid of the cooler, and inflating, while the lid of the cooler is closed, an expandable device positioned in the cooler to occupy at least a portion of a space in the reservoir unoccupied by the contents, thereby securing the contents in the reservoir.

Consistent with some examples, an apparatus for securing contents in a cooler may comprise an expandable device configured to secure contents in a reservoir of the cooler by occupying at least a portion of a space in the reservoir unoccupied by the contents, wherein the expandable device is inflatable and comprises: a flexible membrane conformable to the space in the reservoir unoccupied by the contents, an inflation valve coupled to the flexible membrane and usable to inflate the expandable device, and at least one fastener to removably couple the expandable device to the reservoir.

Additional features are set forth in part in the description that follows and will become apparent to those skilled in the art upon examination of the specification, claims, and drawings or may be learned by the practice of the disclosed subject matter. A further understanding of the nature and advantages of the present disclosure may be realized by reference to the remaining portions of the specification and the drawings, which forms a part of this disclosure.

BRIEF DESCRIPTION OF THE DRAWINGS

The accompanying drawings illustrate implementations of the systems, devices, and methods disclosed herein and together with the description serve to explain the principles of the present disclosure.

Figure 1:
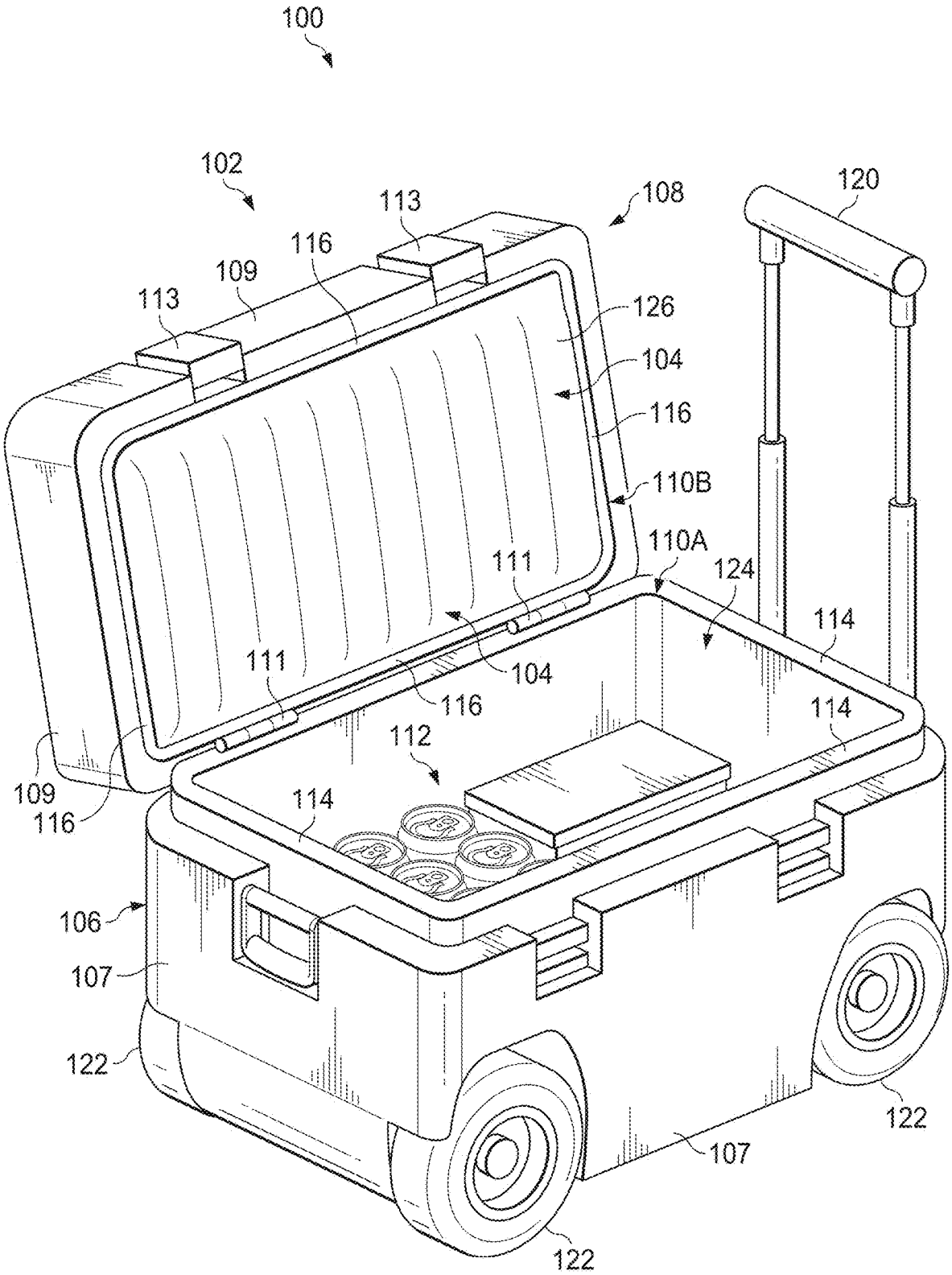
FIG. 1 is a perspective view illustrating a container system for securing contents, in accordance with examples of the present disclosure.

Examples of the present disclosure and their advantages are best understood by referring to the detailed description that follows. It should be appreciated that like reference numerals are used to identify like elements illustrated in one or more of the figures, wherein showings therein are for purposes of illustrating examples of the present disclosure and not for purposes of limiting the same.

DETAILED DESCRIPTION

One of skill in the art will understand that each of the various aspects and features of the disclosure may advantageously be used separately in some instances, or in combination with other aspects and features of the disclosure in other instances. Accordingly, individual aspects can be claimed separately or in combination with other aspects and features. Thus, the present disclosure is merely exemplary in nature and is in no way intended to limit the claims or the applications or uses of the examples herein. It is to be understood that structural and/or logical changes may be made without departing from the spirit and scope of the present disclosure.

The present disclosure contemplates systems and methods for securing contents (e.g., any type of item or good) in all types of containers during transportation. The containers described herein may be any type of container, including but not limited to general-purpose containers, temperature-controlled containers, liquid and gas transport containers, bulk goods containers, small-scale containers, air transport containers, industrial and shipping containers, rail-specific containers, water-specific containers, specialized containers, packaging containers, material-specific containers, transport-specific containers, and flexible goods containers. The containers described herein may be transported via any type of vehicle including, but not limited to, land vehicles, watercrafts, aircrafts, and spacecrafts. Any containers transported via any mode of transportation (e.g., carried, rolled, driven, flown, etc.) will be subjected to movements, vibrations, impacts, and changes in orientation during transport. The unsecured contents within the containers will also be subjected to the movements, vibrations, impacts, and changes in orientation.

Securing container contents using the systems and methods disclosed herein prevents damage to the contents, maintains the integrity of the contents, and increases efficiency in transportation logistics. The described systems and methods require minimal preparation time, may be reusable, and adapt to varying container sizes and content configurations. Further, the systems and methods herein provide flexibility to accommodate items of different shapes, weights, and fragility levels. In the case of temperature-sensitive goods, such as food, beverages, medical supplies, and living organisms, this disclosure provides increased thermal insulation to prevent spoiling and degradation of the contents. As such, the disclosed advancements enhance the safety, efficiency, and usability of containers in a variety of applications, including personal travel, commercial logistics, and specialized fields such as medical transportation.

FIG. 1 shows a container system 100 for securing contents, according to some examples. The container system 100 includes a container 102 and a device 104. In this example, the container 102 is a cooler. As described above, the container 102 may be any type of container. The container 102 comprises a body 106 and a lid 108. The body 106 includes a plurality of walls 107 and the lid 108 includes a plurality of walls 109. The walls 107, 109 include side walls, top walls, and bottom walls, among other directionally-positioned walls. The lid 108 is movably coupled to the body 106 such that the container 102 can be opened and closed. For example, the lid 108 may be rotatably coupled to the body 106 via one or more hinges 111 for opening and closing the container 102. In other examples, the lid 108 is slidably coupled to the body 106. The lid 208 can be secured to the body 106 via latches 113 or other locking mechanisms.

The body 106 and the lid 108 define a reservoir 110. The reservoir 110 may be of any shape and size. The reservoir 110 is configured to hold contents, such as contents 112. The contents 112 may include food and ice, and as explained above, the contents 112 may be any type of item or good. The reservoir 110 may include a lower portion or lower reservoir 110A defined by the body 106 and an upper portion or upper reservoir 110B defined by the lid 108. The lower reservoir 110A includes a plurality of walls 114. The upper reservoir 110B includes a plurality of walls 116. The walls 107 of the body 106 and the walls 114 of the lower reservoir 110A may be spaced by a separation to provide thermal insulation for the contents 112 within the lower reservoir 110A. Similarly, the walls 109 of the lid 108 and the walls 116 of the upper reservoir 110B may be spaced by a separation to provide thermal insulation for the contents 112 within the upper reservoir 110B. The separations may be filled with foam or any other type of insulating material such as air, gas, or a void created by a vacuum.

In FIG. 1, the container 102 is shown in an open configuration used for loading, unloading, and accessing the contents 112. In some examples, the container 102 may include one or more handles 120 and wheels 122 used for transporting the container 102 and the contents 112 therein. In some examples, the container 102 may be placed on and transported by a vehicle. Before transport of the container 102, the container 102 may be placed in a closed configuration, where the lid 108 is engaged with the body 106, thereby preventing the contents 112 from being ejected from the reservoir 110. Because the volume of the contents 112 is less than the volume of the reservoir 110, a space 124 in the reservoir 110 remains unoccupied by the contents 112. The space 124 can be present in both the lower reservoir 110A and the upper reservoir 110B.

With traditional containers, if the contents therein are left unsecured (e.g., when the device disclosed herein is not utilized) the contents may be broken or disturbed when affected by the motions, vibrations, impacts, and changes in orientation during transport. With traditional containers, the unoccupied space allows contents to change their position and orientation relative to the container during transport. When the contents move relative to the container the contents get shaken, broken, displaced, and disturbed. Besides damage to the contents, this discombobulation can generate heat and also increase heat transfer between the container and the contents.

The device 104 may be configured to secure the contents 112 in the reservoir 110. This prevents the contents 112 from being shaken, broken, displaced, or disturbed. Additionally, the device 104 decreases heat transfer from the container 102 to the contents 112 or from the contents 112 to the container 102, thereby increasing thermal insulation of the contents 112 and ensuring that the contents 112 remain in the same state as they were when originally placed in the container 102.

The device 104 may be configured to secure the contents 112 in the reservoir 110 in many different ways. In some examples, the device 104 is disposed in the lower reservoir 110A at a height just above the contents 112 to prevent the contents 112 from elevating above their resting position. The height of the device 104 may be selectively adjusted depending on the height of the contents 112. In some examples, the device 104 secures the contents 112 by extending within the reservoir 110 to match a dimension of the space defined between the contents 112 and a wall of the reservoir 110. In some examples, the device 104 secures the contents 112 by occupying at least a portion of the space 124 in the reservoir 110 unoccupied by the contents 112. By occupying the space 124, the device 104 prevents the contents 112 from moving about the space 124 during transport. The device 104 may occupy and conform to the space 124 in a variety of ways. For example, the device 104 may be inflatable, flexible, extendable, and/or modular, to selectively conform to the space 124 based on the size and shape of the contents 112. In that regard, the device may be referred to as an inflatable device, a flexible device, an extendable device, a modular device, a packaging device, a space conforming device, or any other term.

Figure 2A:
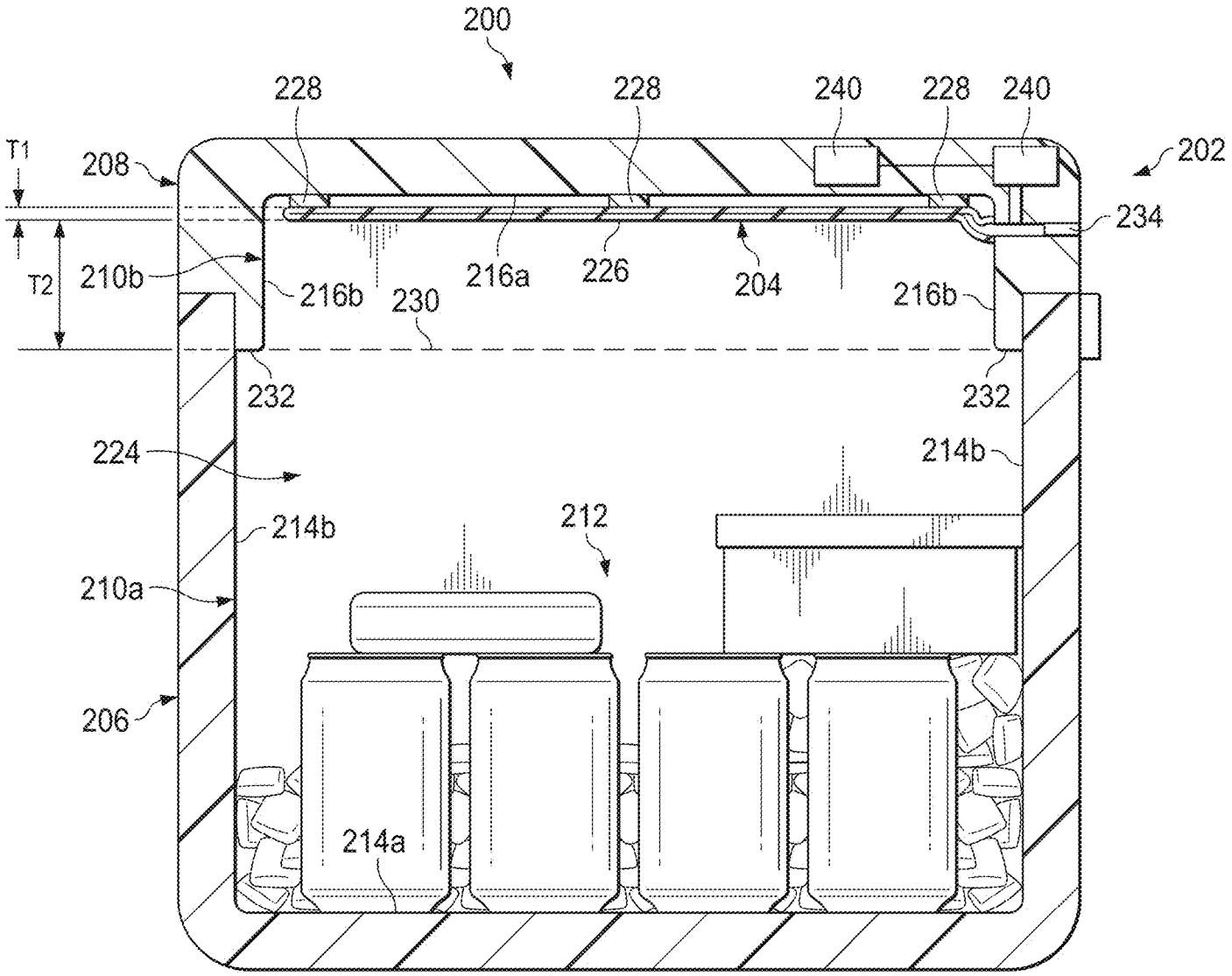
FIGS. 2A and 2B are cross-sections illustrating a container system for securing contents, in accordance with examples of the present disclosure.

FIG. 2A shows a device 204 (which may be similar to the device 104) coupled to a lid 208 of a container 202 and in a stored configuration, according to some examples. Based on its placement coupled to and against a bottom surface or wall 216A of the lid 208, the device 204 does not interrupt typical movement of items in and out of the container 202 during loading and unloading. For example, when the lid 208 is opened and the device 204 is deflated and/or in the stored configuration, contents 212 can be added to and removed from a lower reservoir 210A of a reservoir 210. An upper reservoir 210B is formed by a recess in the lid 208. For illustrative purposes, an axis 230 is shown splitting the lower reservoir 210A from the upper reservoir 210B. The axis 230 is positioned at lowermost portions of 232 of the lid 208. As shown, the device 204, when deflated and/or in the stored configuration, may be shaped to be stored in the recess in the lid 208. When in the stored configuration (e.g., deflated), the device 204 has a thickness T1 smaller than a thickness W2 from the bottom wall 216A to the axis 230. In the stored configuration, the device 204 may occupy less than 75 percent of the volume of the upper reservoir 210B (e.g., 75 percent, 50 percent, 30 percent, 20 percent, 15 percent, 10 percent, 8 percent, 5 percent, 3 percent, etc.) In some examples, the deflated device 204 is as thick as twice the thickness of the flexible membrane 226. When deflated, the shape of the device 204 corresponds to the shape of the surfaces of the container 202 that the device 204 is deflated against or coupled to.

The device 204 is coupled within the reservoir 210. In this example, the device 204 is removably coupled to a downwardly facing surface of a bottom wall 216A of the lid 208 via a plurality of fastening mechanisms 228. The fastening mechanisms 228 may be disposed on the container 202 (e.g., the body 206 or the lid 208), on the device 204, or on both. The fastening mechanisms 228 are configured to fixedly or removably attach, fasten, and couple the device 204 to the container 202. In that regard, the device 204 may also be attached to a side wall 216B of the lid 208, a bottom wall 214A of the body 206, and/or a side wall 214B of the body 206. Although three fastening mechanisms 228 are shown, more or fewer fastening mechanisms are contemplated. The fastening mechanisms 228 may be distributed about the device 204, the lid 208, and/or the body 206 in a plurality of dimensions to keep the device 204 evenly supported and attached. In some examples, the fastening mechanism 228 are disposed only on the device 204 so that the device 204 can be coupled to any generic container or cooler. In some examples, each fastening mechanism 228 has at least two portions, a device portion and a container portion, the device portion and the container portion being attachable to each other. The container portion of each fastening mechanism 228 may be included on the container 202 during manufacture or applied by a user seeking to couple the device 204 thereto. The fastening mechanisms 228 may be any type of fastening mechanism, for example, snap fasteners, hook and loop (e.g., Velcro), adhesive, suction cups, zippers, clamps (e.g., spring clamps), latches, catches, pin and hole mechanisms, twist-lock mechanisms, magnets and magnetic strips, and removable or two-sided tape, among others.

Figure 2B:
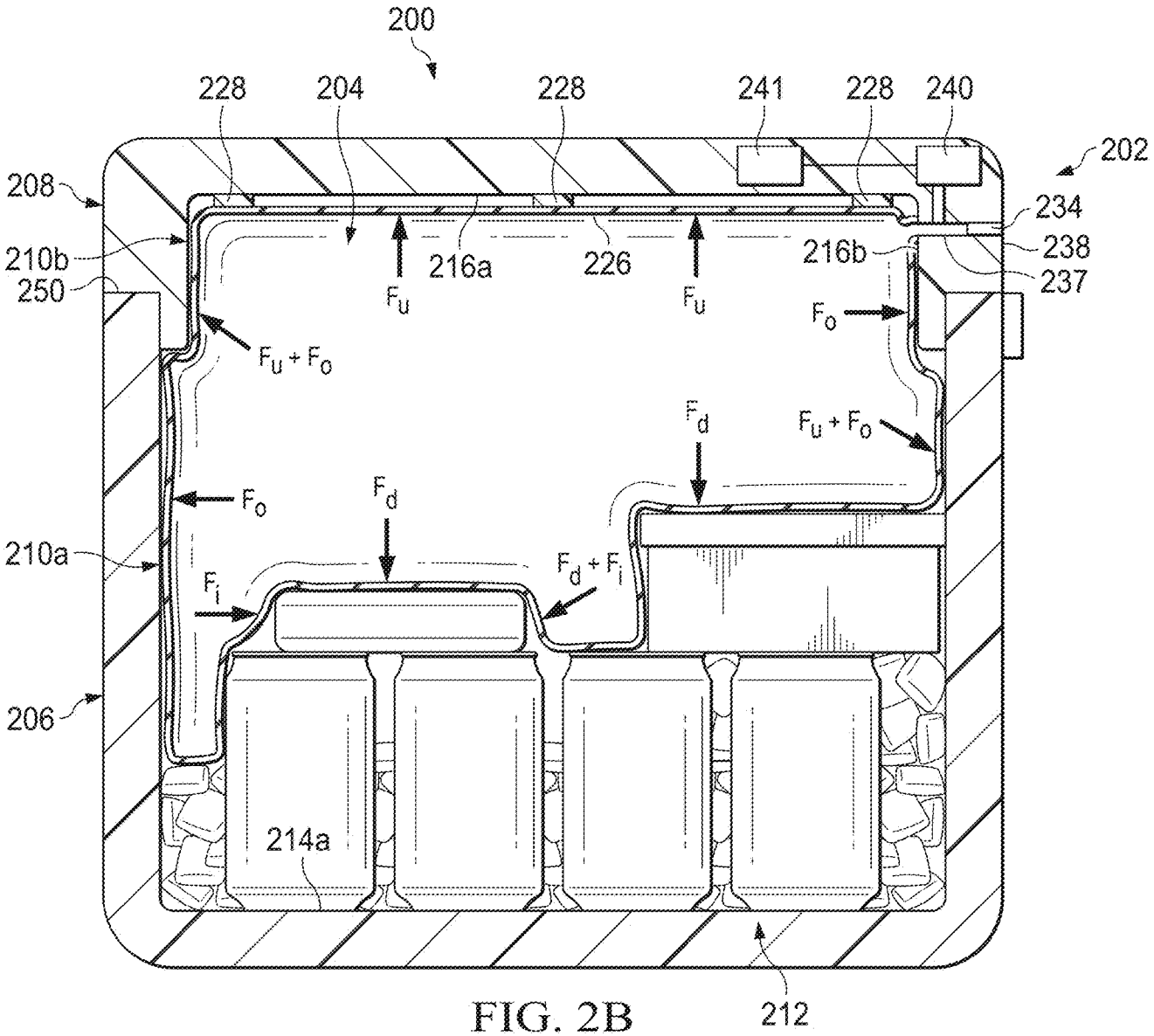

FIG. 2B shows the device 204 coupled to a lid 208 of a container 202 and in a deployed configuration securing the contents 212 within the container 202, according to some examples. In this example, the device 204 is inflatable. When the device 204 is inflated, the device 204 applies one or more upward forces $F_u$ against the lid 208 and one or more downward forces $F_d$ against the contents 212. Similarly, depending on the position of the device 204 and the contents 212 within the reservoir 210, the device 204 may apply one or more outward forces $F_o$ against the body 206 and one or more inward forces $F_i$ against the contents 212. The forces applied by the device 204 cause the contents 212 to press against each other, against the walls 214, 216 of the reservoir 210, and against the device 204 itself. In this way, the device 204 places the contents 212 in static equilibrium such that the forces applied to and carried throughout the container system 200 during transport are smaller than the static friction between the contents, the walls 214, 216, and the device 204.

The device 204 can be inflated with any conformable or thermally-insulating substance. For example, the device 204 can be inflated with air, argon, krypton, xenon, nitrogen, aerogels, foams, etc., or any combination thereof. The device 204 is shown partially and selectively inflated, based on the volume of the contents 212 in the reservoir 210. In that regard, the device 204 is configured to inflate to a volume similar to or less than the difference (e.g., the space 224) in the volume between the reservoir 210 and the contents 212.

The device 204 includes a flexible membrane 226 conformable to the space 224. The device 204 may be re-usable to secure the contents 212 in the reservoir during a first use (e.g., the use shown in FIG. 2B) and a second use (e.g., after some of the contents 212 have been removed or added) to secure second contents. The device 204 may be deflatable between uses. The flexible membrane 226 is conformable to a first configuration based on a first shape of the space 224 in the reservoir 210 unoccupied by the contents 212 and conformable to a second configuration based on a second shape of the space 224 unoccupied by second components. The first shape of the space 224 may be different than the second shape of the space 224 such that the shape of the first configuration of the device 204 is different than a shape of the second configuration of the device 204. The flexible membrane 226 is conformable to any number of shapes to allow for the device 204 to secure any type or shape of contents in the container 202.

As shown in FIG. 2B, the device 204 may occupy substantially all of the unoccupied space 224 when in the deployed configuration. The device 204 in some instances may not occupy substantially all of the space 224 to secure the contents 212. For example, the device 204 may occupy a quarter, a third, half, three quarters, or any percentage of the space 224. For example, the device 204 may alternatively be coupled at a location recessed within the reservoir 210A of the body 206. In such a use case, the device 204 be inflated with a minimal amount of air (e.g., less than 5 percent of the total inflated volume of the device 204) to fill the crevices and spaces between the contents 212.

The flexible membrane 226 may be made of any material that conforms to the shape of its environment when inflated. For example, the flexible membrane 226 may be polyvinyl chloride, thermoplastic polyurethane, polyethylene, polypropylene, polyurethane-coated nylon, polyester, silicone-coated fabrics, nylon or polyester with TPU/PVC coating, neoprene coated fabric, Hypalon, latex rubber, silicone rubber, EPDM rubber, EVA foam, memory foam with chambers, or an aerogel-filled membrane, among other materials. In some examples, the flexible membrane 226 is dimensioned to match the dimensions and volume of the reservoir 210 when fully inflated. In other examples, the device is not inflatable and occupies the space by expanding from a compressed state. For example, the device 204 may be a foam, sponge, or other expanding type of material.

In some examples, the device 204 includes an inflation valve 234. The inflation valve 234 may also function as a release valve (not shown) or a separate release valve may be included. The inflation valve 234 may be coupled to an accessible through an access port 237 extending through the container 202. In some examples, the access port 237 extends through a side wall 216B of the upper reservoir 210B and an exterior wall 238 of the lid 208. The access port 237 may be located in any portion of the container 202 such that the inflation valve 234 is accessible through any portion or wall of the container 202 from any direction. Because the inflation valve 234 is accessible from outside the container 202 when the lid 208 is closed, the device 204 can be inflated to fill the unoccupied space 224. Being able to inflate the device 204 while the lid is closed provides fixed boundaries and dimensions for the device 204 to inflate into. Furthermore, because the lid 208 is closed on the body 206, and sometimes locked together via the latches 113, any forces caused by the inflating device 204 are met with equal and opposite forces applied by the enclosed container 202. If the device 204 is inflated prior to closing the lid 208, the device 204 may be underinflated and the user would be unaware that the device is underinflated. If overinflated, the user would be unable to close the lid 208 or the contents therein may be crushed due to too much pressure. The accessibility of the inflation valve 234 through the access port 237 provides the advantage of accurately inflating the device 204 to the proper degree, regardless of the variable amount of unfilled space the user is seeking to fill in various situations.

The system may also include a pump 240 usable to inflate the device 204. The pump 240 may be integrated into the container 202 or the device 204 or may be separate from both. In some examples, the pump 240 is a manual pump. In other examples, the pump 240 is an automatic pump. The pump 240 is configured to introduce air into the flexible membrane 226 of the device 204 via the inflation valve 234. The pump may be housed in the lid 208. The pump 240 may be connectable to a power supply that is stored on or separate from the device 204. In some examples, the power supply is a battery 241 housed in the lid 208.

If the pump 240 is a manual pump and separate from the container 202 and the device 204, the pump may be selectively engaged or mated with the inflation valve 234. After the pump is used to inflate the flexible membrane 236, the pump may be removed from the inflation valve 234 and stored within a compartment or separate from the container 202 during transport.

If the pump 240 is a manual pump and integrated into the container 202 or the device 204, the pump may include an arm or button that, when actuated or reciprocated back and forth, pushes air through the inflation valve 234 into the flexible membrane 226. The integrated manual pump may be accessible from outside the container 202 when the lid 208 is closed. For example, the arm or button may be disposed on an exterior surface of the lid 208 or body 206. In yet other examples, the integrated manual pump may be located underneath a cover on a top surface of the lid 208. I yet other examples, the pump 240 is located within the container 202 and accessible only when the lid 208 is open.

If the pump 240 is an automatic pump, whether separated from or integrated into the container 202 and/or the device 204, the automatic pump may begin or stop inflating/deflating the device 204 upon receipt of a signal from a pressure sensor 242 indicating a pressure within the device 204. For example, when the pressure sensor 242 senses and sends a signal indicating that the pressure inside the device is below a threshold pressure range, the automatic pump may begin inflation. When the pressure sensor 242 senses and sends a signal indicating that the pressure inside the device 204 is within a threshold pressure range, the automatic pump stops inflation. When the pressure is lower than a drops below a threshold pressure range, the automatic pump begins inflation. If the pressure is higher than a threshold pressure range, the pump begins deflation until either the pressure is within the desired pressure range or until the device 204 is fully deflated.

In some examples, the inflation valve 234 or another valve may act as a blow-off valve. Upon inflation, whether manual or automatic, the blow-off valve may be configured to release air from the system when the pressure reaches a pressure maximum. The blow-off valve may know when the pressure maximum is reached based on the pressure sensor 242 or mechanically, where a pressure level, such as the pressure maximum, opens the blow-off valve. In some examples, the blow-off valve makes a noise when releasing air from the system, indicating to the user that the pressure maximum has been reached and that they can stop the inflation.

It is also contemplated that the device 204 may be manually inflatable without the use of the pump 240. In yet other examples, the device 204 is self-inflating. For example, the device 204 may be compressed and deflated before closing the inflation valve 234. The device 204 does not self-inflate until the inflation valve 234 is opened and/or restraints are removed from the device 204 that allow the device 204 to uncompress and fill with air.

Figure 3:
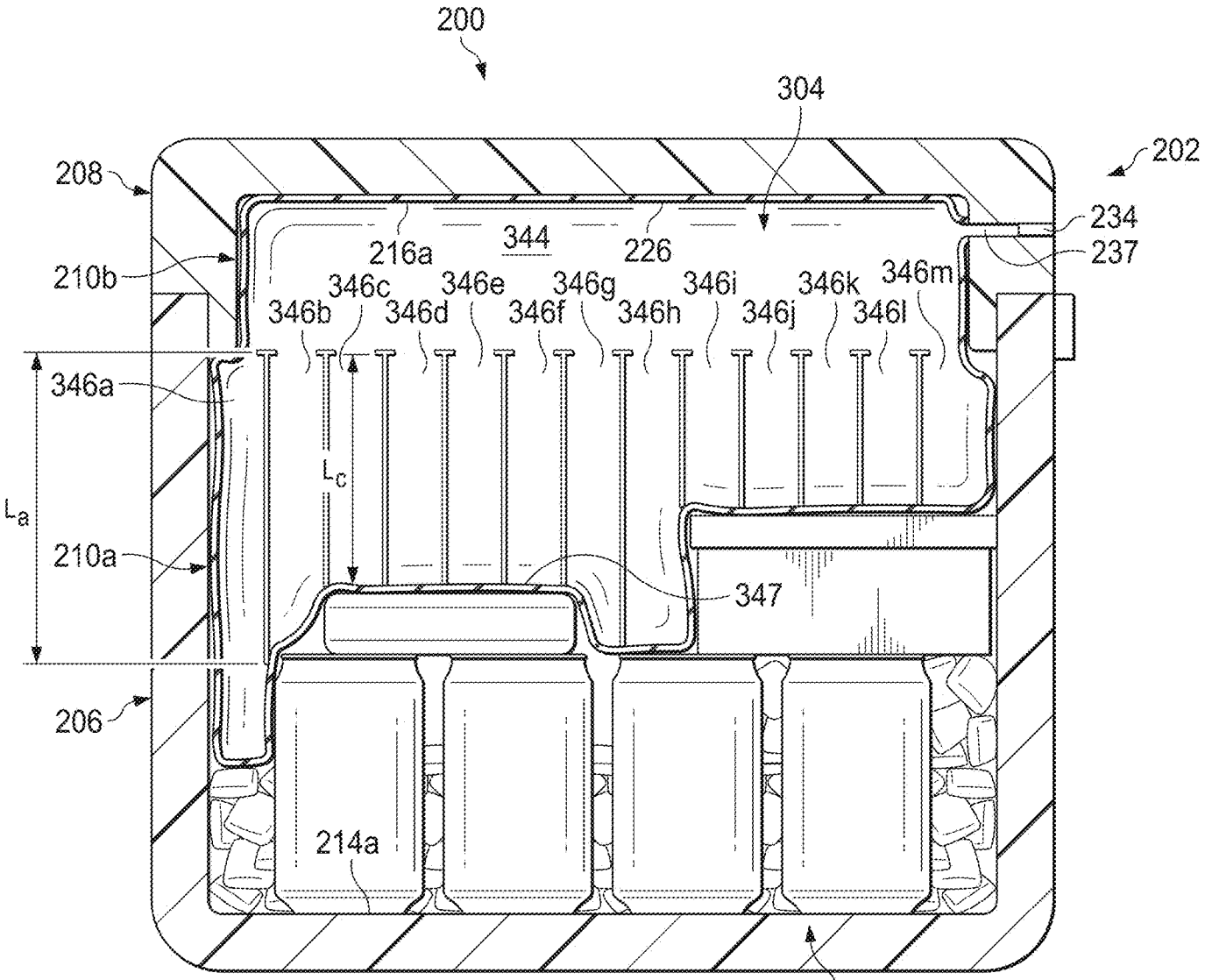
FIG. 3 is a cross-section illustrating a container system for securing contents, in accordance with examples of the present disclosure.

FIG. 3 shows an inflated device 304 (which may be similar to the devices 104, 204) within a reservoir 310. The device 304 may be similar to the devices 104, 204, with possible differences as described. The device 304 may have a main chamber 344 fluidically coupled to a plurality of extension chambers 346. The extension chambers 346 may include a circular wall or a plurality of walls extending downwards from the main chamber 344. A fluidic opening exists where the walls of the extension chamber 346 meet the bottom side of the main chamber 344. In some examples, the device 304 does not include a main chamber 344 and each extension chamber is fluidically connected to the pump 240 via a respective channel. There may be more or fewer of the extension chambers 346 than shown. For example, FIG. 3 is shown as a cross-section of the container 202, but it fully understood that additional extension chambers may be located in front of or behind (e.g., into and out of the page) the extension chambers 346 shown. Each of the extension chambers 346 are configured to occupy a respective space above the contents 212 in the container 202. The plurality of extension chambers 346 allows the device 304 to conform to irregular shaped contents and contents positioned in a manner to form unoccupied spaces that have drastic changes in dimensions. The inflated length of each extension chamber 346 corresponds to a height of the respective contents that the extension chamber 346 is positioned above. For example, the Length $L_a$ of the inflated extension chamber 346*a* is greater than the length $L_c$ of the inflated extension chamber 346*c* because the height of the contents 212 below the extension chamber 346*a* is smaller than the height of the contents 212 below the extension chamber 346*c*. In this way, the device 304 can selectively conform and adapt to the varying heights of contents within the reservoir 210.

In some examples, the device 304 does not include the main chamber 344 but includes the plurality of extension chambers 346. In such a configuration, the length of the extension chambers 346 when inflated may correspond to a distance between the bottom wall 216*a* of the lid 208 and a top surface 347 of the contents 212 located below the respective extension chamber 346.

Figure 4:
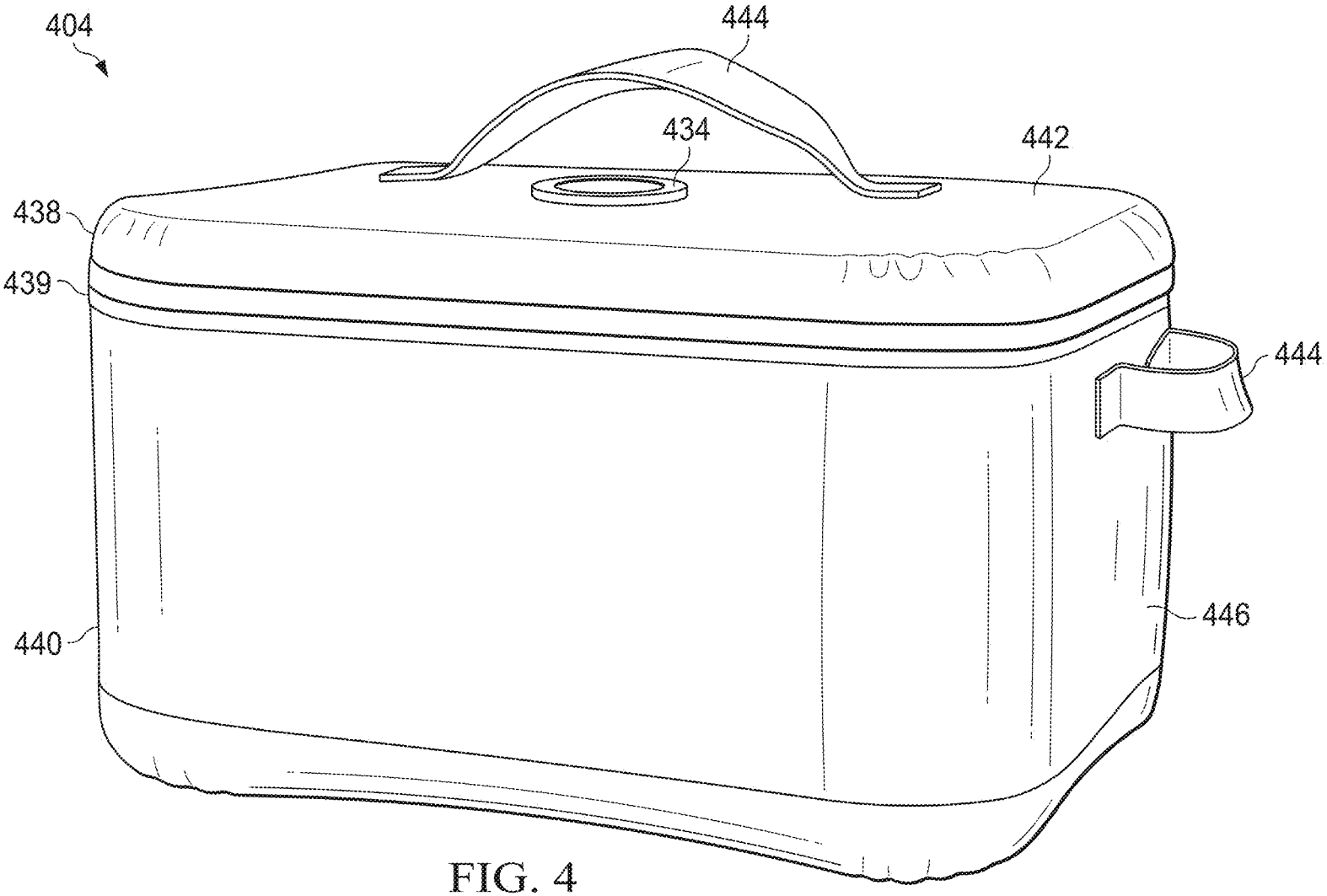
FIG. 4 is a perspective view illustrating a device for securing contents in a container, in accordance with examples of the present disclosure.

FIG. 4 shows an apparatus or device 404 (which may be similar to the devices 104, 204, 304) that is unattached from any containers (e.g., the containers 102, 202). The device 404 is configured to secure contents within a container while being housed within a container without being attached to the container. As such, the device 404 is usable with any container. The device 404 may include a upper chamber 438 and a lower chamber 440. The upper chamber 438 is configured to nest within an upper reservoir (e.g., the upper reservoirs 110*b*, 210*b*) of a container. Similarly, the lower chamber 440 is configured to nest within a lower reservoir (e.g., the lower reservoirs 110*a*, 210*a*) of a container. In that regard, the upper chamber 438 may be manufactured to correspond to the volume of the upper reservoir of the container and the lower chamber 440 may be manufactured to correspond to the volume of the lower reservoir of the container.

The device 404 can be placed into a container before or after it is inflated. The device 404 may include an inflation valve 434 positioned on a top surface 442 of the device 404. Because the inflation valve 434 is located on the top surface 442, the device 404 can be inflated after it has been disposed in a reservoir (e.g., the reservoirs 110, 210) of a container.

If the device 404 is placed in the reservoir of the container prior to inflation, the user can inflate the device 404 until a converging seam 439 between the upper chamber 438 and the lower chamber 440 is aligned with the or above an upper edge 250 (e.g., see FIG. 2B) of the body 206.

If the device 404 is placed in the container after inflation, the user may first inflate the device 404 until the volume of the device is substantially the same as the unoccupied space in the container. When closing the lid of the container, the user can tell whether the device 404 is inflated to the proper volume based on the amount of resistance felt when closing the lid.

After use, the device 404 can be removed from the container and deflated until a future use. In some examples, the device 404 includes handles 444 attached to the top surface 442 or a side surface 446. The handles 444 are usable to lower the device 404 into or remove the device 404 from the container.

The present disclosure contemplates a method for securing contents in a cooler. At one step, a device (e.g., the devices 104, 204, 304, 404) is placed on to of contents in a reservoir (e.g., the reservoirs 110, 210, 310) of a cooler. It is fully understood that the device may be placed below or on the sides of the contents in the reservoir, depending on the application and use case. In another step, a lid (e.g., the lids 108, 208) of the cooler is closed. At another step, the device is inflated or otherwise expanded while the lid of the cooler is closed. The device may be inflated when the lid is closed via one of the many methods described above. For example, the device may be accessible through the cooler or the device may be self-inflating. After inflation, the device occupies at least a portion of a space (e.g., the spaces 124, 224) in the reservoir unoccupied by the contents, thereby securing the contents in the reservoir. It is fully understood that the device may be inflated prior to closing the lid in some examples.

All relative and directional references (including up, down, upper, lower, top, bottom, side, front, rear, and so forth) are given by way of example to aid the reader's understanding of the examples described herein. They are not requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

The present disclosure teaches by way of example and not by limitation. Therefore, the matter contained in the above description or shown in the accompanying drawings are interpreted as illustrative and not in a limiting sense. The following claims are intended to cover all generic and specific features described herein, as well as all statements of the scope of the present method and system, which, as a matter of language, might be said to fall therebetween.

What is claimed is:

1. A system for securing contents, the system comprising:

a cooler comprising a body and a lid, the body and the lid defining a reservoir to hold the contents; and an expandable device positionable in the cooler and configured to secure the contents in the reservoir by occupying at least a portion of a space in the reservoir unoccupied by the contents, wherein the expandable device is inflatable and reusable to secure the contents in the reservoir during a first use and to secure second contents in the reservoir during a second use, the expandable device being deflatable between the first use and the second use, wherein the expandable device comprises:

a main chamber; and a plurality of extension chambers each formed by walls extending from the main chamber, wherein the walls separate the plurality of extension chambers such that the plurality of extension chambers are movable with respect to each other, and wherein inflating the expandable device causes each respective extension chamber to selectively inflate to a length that accommodates a height of respective contents held in the reservoir below the respective extension chamber.

2. The system of claim 1, wherein the expandable device is inflatable when the lid is closed.

3. The system of claim 1, wherein the expandable device, when inflated, is configured to apply an upward force against the lid and a downward force against the contents to secure the contents in the reservoir.

4. The system of claim 1, wherein the expandable device comprises a flexible membrane conformable to a first configuration based on a first shape of the space in the reservoir unoccupied by the contents and conformable to a second configuration based on a second shape of the space in the reservoir unoccupied by second contents.

5. The system of claim 4, wherein the first shape of the space is different than the second shape of the space such that the first configuration is different than the second configuration.

6. The system of claim 1, wherein occupying at least the portion of the space in the reservoir unoccupied by the contents includes occupying at least a third of the space in the reservoir unoccupied by the contents.

7. The system of claim 1, wherein the expandable device is coupled to the reservoir when securing the contents.

8. The system of claim 7, wherein the expandable device includes at least one fastening mechanism configured to removably couple the expandable device to a downwardly facing surface of the lid.

9. The system of claim 1, wherein the expandable device is housed within but unattached from the cooler when securing the contents.

10. The system of claim 1, wherein an upper portion of the reservoir is formed by a recess in the lid, and wherein the expandable device, when deflated, is shaped to be stored in the recess in the lid.

11. The system of claim 1, wherein the expandable device comprises an inflation valve and wherein the cooler comprises an access port, the inflation valve being accessible through the access port.

12. The system of claim 11, wherein the access port extends through a side wall of the lid.

13. The system of claim 1, wherein the expandable device comprises at least one handle usable to insert and remove the expandable device from the cooler between uses.

14. The system of claim 1, further comprising:

at least one pressure sensor configured to monitor a pressure inside the expandable device; and a pump configured to:

inflate the expandable device; and automatically reinflate the expandable device upon receipt of a signal from the at least one pressure sensor indicating that the monitored pressure inside the expandable device has dropped below a threshold pressure range.

15. The system of claim 14, wherein the pump is integrated into the cooler.

16. The system of claim 14, wherein the pump is couplable to the cooler.

17. The system of claim 14, wherein the pump is configured to stop inflating the expandable device upon receipt of a signal from the at least one pressure sensor indicating that the monitored pressure inside the expandable device is within the threshold pressure range.

18. The system of claim 14, wherein the pump is configured to automatically deflate the expandable device upon receipt of a signal from the at least one pressure sensor indicating that the monitored pressure inside the expandable device has risen above the threshold pressure range.

19. A method for securing contents, the method comprising:

positioning an expandable device in a reservoir holding contents, the reservoir defined by a body and a lid of a cooler, wherein the expandable device comprises:

a main chamber; and a plurality of extension chambers each formed by walls extending from the main chamber, wherein the walls separate the plurality of extension chambers such that the plurality of extension chambers are movable with respect to each other; and inflating the expandable device to secure the contents in the reservoir by occupying at least a portion of a space in the reservoir unoccupied by the contents, wherein inflating the expandable device causes each respective extension chamber to selectively inflate to a length that accommodates a height of respective contents held in the reservoir below the respective extension chamber.

20. An apparatus for securing contents in a cooler, the apparatus comprising:

an expandable device configured to secure contents in a reservoir of the cooler by occupying at least a portion of a space in the reservoir unoccupied by the contents, wherein the expandable device is inflatable and comprises:

a main chamber; and a plurality of extension chambers each formed by walls extending from the main chamber, wherein the walls separate the plurality of extension chambers such that the plurality of extension chambers are movable with respect to each other, and wherein inflating the expandable device causes each respective extension chamber to selectively inflate to a length that accommodates a height of respective contents held in the reservoir below the respective extension chamber.

* * * * *